US010065417B2

(12) United States Patent
Nishimura

(10) Patent No.: US 10,065,417 B2
(45) Date of Patent: Sep. 4, 2018

(54) TEMPERATURE UNIFORMITY ACROSS AN INKJET HEAD USING PIEZOELECTRIC ACTUATION

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/702,444

(22) Filed: Sep. 12, 2017

(65) Prior Publication Data

US 2018/0001627 A1 Jan. 4, 2018

Related U.S. Application Data

(63) Continuation of application No. 15/058,089, filed on Mar. 1, 2016, now Pat. No. 9,796,177.

(51) Int. Cl.
*B41J 2/045* (2006.01)

(52) U.S. Cl.
CPC ..... *B41J 2/04563* (2013.01); *B41J 2/04528* (2013.01); *B41J 2/04581* (2013.01); *B41J 2/04591* (2013.01); *B41J 2/04596* (2013.01)

(58) Field of Classification Search
CPC ..... B41J 2/04581; B41J 2/04588; B41J 2/04595; B41J 2/04596; B41J 2/17563; B41J 2/0451; B41J 2/1752; B41J 2/04541; B41J 2002/10
See application file for complete search history.

(56) References Cited

U.S. PATENT DOCUMENTS

2010/0165029 A1* 7/2010 Gibson ..... B41J 2/04528 347/14

* cited by examiner

*Primary Examiner* — Thinh H Nguyen
(74) *Attorney, Agent, or Firm* — Duft Bornsen & Fettig LLP

(57) ABSTRACT

Systems and method of maintaining a uniform temperature distribution in an inkjet head. The inkjet head includes a plurality of ink channels that jet droplets of a liquid material onto a medium using piezoelectric actuators. A temperature controller includes a non-jetting pulse generator that provides non-jetting pulses to one or more of the piezoelectric actuators to generate heat. The non-jetting pulses cause the piezoelectric actuators to actuate without jetting a droplet from its corresponding ink channel.

20 Claims, 7 Drawing Sheets

TEMPERATURE UNIFORMITY ACROSS AN INKJET HEAD USING PIEZOELECTRIC ACTUATION

RELATED APPLICATIONS

This non-provisional patent application is a continuation of U.S. patent application Ser. No. 15/058,089 filed on Mar. 1, 2016, which is incorporated herein by reference.

FIELD OF THE INVENTION

The following disclosure relates to the field of printing, and in particular, to inkjet heads used in printing.

BACKGROUND

Inkjet printing is a type of printing that propels drops of ink (also referred to as droplets) onto a medium, such as paper, a substrate for 3D printing, etc. The core of an inkjet printer includes one or more print heads (referred to herein as inkjet heads) having multiple ink channels arranged in parallel to discharge droplets of ink. A typical ink channel includes a nozzle, a chamber, and a mechanism for ejecting the ink from the chamber and through the nozzle, which is typically a piezoelectric actuator connected to a diaphragm. To discharge a droplet from an ink channel, a drive circuit provides a drive waveform to the piezoelectric actuator of that ink channel that includes a jetting pulse. In response to the jetting pulse, the piezoelectric actuator generates pressure oscillations inside of the ink channel to push the droplet out of the nozzle. The drive waveforms provided to individual piezoelectric actuators control how droplets are ejected from each of the ink channels.

In an attempt to reduce the size of inkjet heads, the ink channels within the inkjet heads are moved closer together. Also, Drop on Demand (DoD) printing is moving towards higher productivity and quality, which requires small droplet sizes ejected at high jetting frequencies. The print quality delivered by an inkjet head depends on ejection or jetting characteristics, such as droplet velocity, droplet mass (or volume/diameter), jetting direction, etc. Temperature of an inkjet head or the ink in the inkjet head may influence ink viscosity and piezo capacitance, which in turn affects the jetting characteristics. It is therefore desirable to mitigate the effects of temperature variations across an inkjet head to achieve high quality printing.

SUMMARY

Embodiments described herein use the piezoelectric actuators to impart heat into the inkjet head. A conventional inkjet head may include heaters that are embedded into the head. However, the heaters may not be embedded in such a way to provide a uniform temperature distribution across the inkjet head. The embodiments described herein are able to provide a uniform temperature distribution across or throughout an inkjet head by selectively firing piezoelectric actuators in the inkjet head. A drive circuit provides non-jetting pulses to the piezoelectric actuators that cause the piezoelectric actuators to actuate, but do not cause jetting of droplets from the ink channels. The piezoelectric actuator converts the electrical energy from the non-jetting pulses into heat, but will not cause droplets to be ejected from its corresponding ink channel. The drive circuit may selectively provide these non-jetting pulses to piezoelectric actuators in the inkjet head to produce a uniform temperature distribution across the inkjet head.

One embodiment is a system that includes an inkjet head comprising a plurality of ink channels that jet droplets of a liquid material onto a medium using piezoelectric actuators. The system further includes a jetting pulse generator configured to provide jetting pulses to the piezoelectric actuators to jet the droplets from the ink channels. The system further includes a temperature controller comprising a non-jetting pulse generator configured to provide non-jetting pulses to at least one of the piezoelectric actuators to generate heat. The non-jetting pulses cause the at least one of the piezoelectric actuators to actuate without jetting a droplet from its corresponding ink channel.

In another embodiment, the non-jetting pulses have a pulse width that is longer than the jetting pulses.

In another embodiment, a pulse width of the non-jetting pulses is between a first set of resonant frequencies of the ink channels, and a second set of resonant frequencies of the ink channels.

In another embodiment, the non-jetting pulse generator is configured to apply the non-jetting pulses to the at least one of the piezoelectric actuators that have not been used for a threshold time period.

In another embodiment, the temperature controller further includes sensor elements configured to monitor a temperature in the inkjet head. The non-jetting pulse generator is configured to provide the non-jetting pulses to at least one of the piezoelectric actuators responsive to a determination that the temperature in the inkjet head is below a threshold.

In another embodiment, the sensor elements are embedded in the inkjet head, and each sensor element is associated with a different region of the inkjet head. The non-jetting pulse generator is configured to identify a region of the inkjet head where the temperature in the region is below the threshold, to identify the at least one of the piezoelectric actuators located in the region of the inkjet head, and to provide the non-jetting pulses to the at least one of the piezoelectric actuators located in the region of the inkjet head.

In another embodiment, the non-jetting pulse generator is configured to increase a number of the non-jetting pulses provided to the at least one of the piezoelectric actuators to increase the heat generated by the at least one of the piezoelectric actuators, and to decrease the number of the non-jetting pulses provided to the at least one of the piezoelectric actuators to decrease the heat generated by the at least one of the piezoelectric actuators.

In another embodiment, the non-jetting pulse generator is configured to increase an amplitude of the non-jetting pulses to increase the heat generated by the at least one of the piezoelectric actuators, and to decrease the amplitude of the non-jetting pulses to decrease the heat generated by the at least one of the piezoelectric actuators.

Another embodiment comprises a method of operating an inkjet head comprising a plurality of ink channels that jet droplets of a liquid material onto a medium using piezoelectric actuators. The method includes providing jetting pulses to the piezoelectric actuators to jet the droplets from the ink channels, and providing non-jetting pulses to at least one of the piezoelectric actuators to generate heat. The non-jetting pulses cause the at least one of the piezoelectric actuators to actuate without jetting a droplet from its corresponding ink channel.

Another embodiment comprises a system that includes a temperature controller coupled to an inkjet head, where the inkjet head includes plurality of ink channels that jet droplets of a liquid material onto a medium using piezoelectric actuators. The temperature controller includes a non-jetting pulse generator configured to provide non-jetting pulses to at least one piezoelectric actuator to generate heat in the inkjet head without jetting droplets from its corresponding ink channel.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
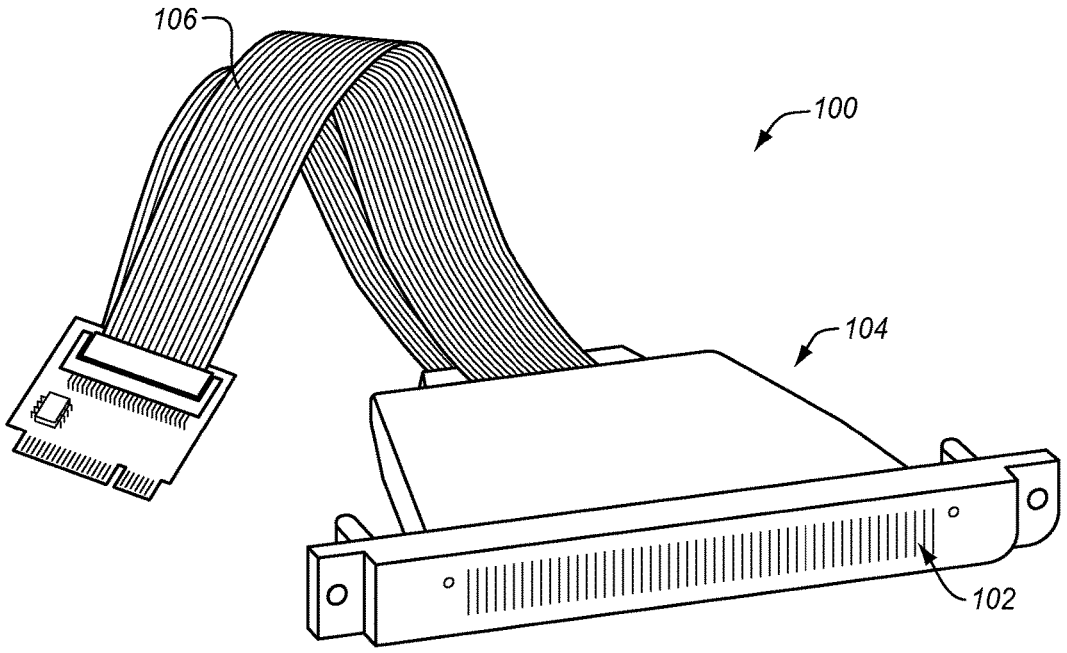
FIG. 1 illustrates an inkjet head.

FIG. 1 illustrates an inkjet head 100. Although not visible in FIG. 1, inkjet head 100 includes one or more rows of nozzles on a nozzle plate surface 102 that jet or eject droplets of liquid material, such as ink (e.g., water, solvent, oil, or UV-curable). Inkjet head 100 may comprise a single color, two color, or four color head. Inkjet head 100 includes integrated electronics 104 that connect to a data source through cabling 106.

Figure 2:
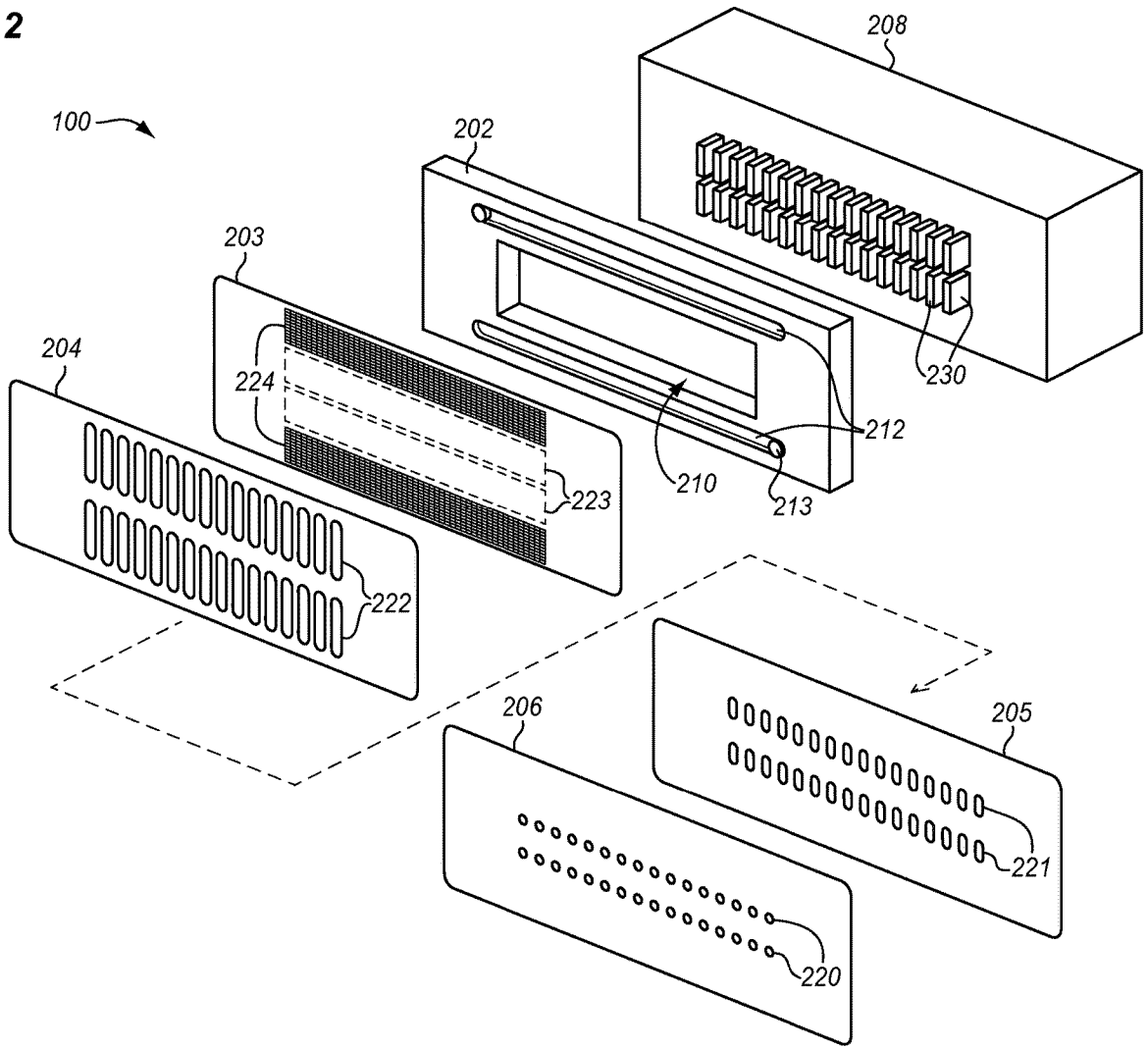
FIG. 2 illustrates an exploded, perspective view of an inkjet head.

FIG. 2 illustrates an exploded, perspective view of inkjet head 100. Inkjet head 100 forms a plurality of ink channels that are each capable of dispersing ink. Although the term "ink" is used herein, inkjet head 100 is capable of dispersing different types of liquid material used for printing. Each ink channel includes a nozzle, a chamber, and a mechanism for ejecting ink from the chamber and through the nozzle, which is typically a diaphragm and a piezoelectric actuator.

In this example, inkjet head 100 includes a housing 202, a series of plates 203-206, and a piezoelectric device 208. Housing 202 is a rigid member to which the plates 203-206 attach to form inkjet head 100. Housing 202 includes an opening 210 for piezoelectric device 208 to pass through and interface with a diaphragm plate 203. Housing 202 further includes one or more grooves 212 on a surface that faces plates 203-206 for supplying ink to the ink channels. Groove 212 includes one or more holes 213 that are in fluid communication with an ink reservoir.

The plates 203-206 of inkjet head 100 are fixed or bonded to one another to form a laminated plate structure, and the laminated plate structure is affixed to housing 202. The laminated plate structure includes the following plates: an orifice plate 206, one or more chamber plates 205, a restrictor plate 204, and diaphragm plate 203. Orifice plate 206 includes a plurality of nozzles 220 that are formed in one or more rows. Chamber plate 205 is formed with a plurality of chambers 221 that correspond with the nozzles 220 of orifice plate 206. The chambers 221 are each able to hold ink that is to be ejected out its corresponding nozzle 220. Restrictor plate 204 is formed with a plurality of restrictors 222. The restrictors 222 fluidly connect chambers 221 to the ink supply, and control the flow of ink into chambers 221. Diaphragm plate 203 is formed with diaphragms 223 and filter sections 224. Diaphragms 223 each comprise a sheet of a semi-flexible material that vibrates in response to actuation by piezoelectric device 208. Filter sections 224 remove foreign matter from ink entering into the ink channels.

Piezoelectric device 208 includes a plurality of piezoelectric actuators 230; one for each of the ink channels. The ends of piezoelectric actuators 230 contact diaphragms 223 in diaphragm plate 203. An external drive circuit (e.g., electronics 104) is able to selectively apply drive waveforms to piezoelectric actuators 230, which vibrate the diaphragm 223 for individual ink chambers. The vibration of diaphragms 223 causes ink to be ejected or jetted from its corresponding nozzle 220. Inkjet head 100 can therefore print desired patterns by selectively "activating" the ink channels to discharge ink out of their respective nozzles.

Figure 3:
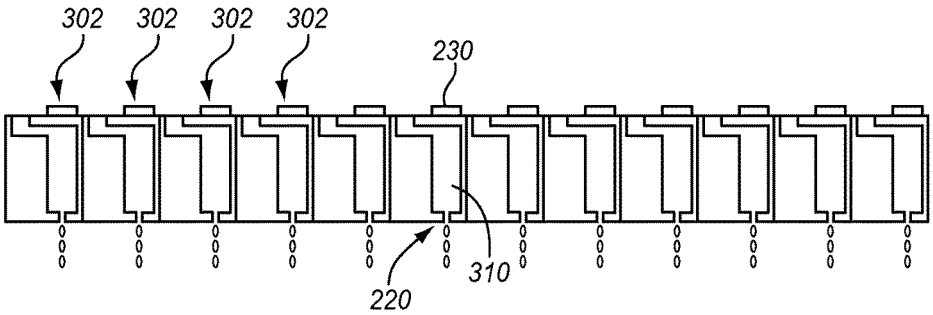
FIG. 3 is a cross-sectional view of a set of ink channels within an inkjet head.

FIG. 3 is a cross-sectional view of a set of ink channels 302 within inkjet head 100. Inkjet head 100 includes multiple ink channels 302 in parallel, a portion of which are illustrated in FIG. 3. Each ink channel 302 includes a piezoelectric actuator 230, a chamber 310, and a nozzle 220. Piezoelectric actuators 230 are configured to receive drive waveforms, and to actuate or "fire" in response to a jetting pulse on the drive waveform. Firing of a piezoelectric actuator 230 in an ink channel 302 creates pressure waves within the ink channel 302 that cause jetting of droplets from the nozzles 220.

Figure 4:
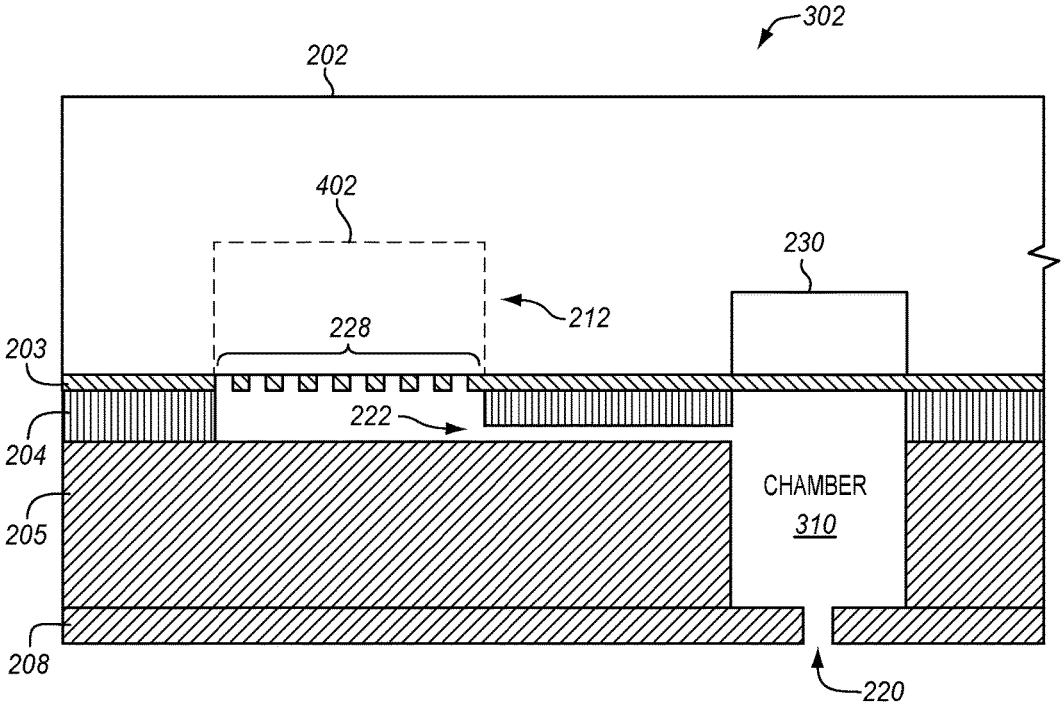
FIG. 4 is a cross-sectional view of an individual ink channel.

FIG. 4 is a cross-sectional view of an individual ink channel 302. The plate structure illustrated in FIG. 4 is intended to be an example of the basic structure of an ink channel 302. There may be additional plates that are used in the plate structure that are not shown in FIG. 4, and FIG. 4 is not necessarily drawn to scale. Diaphragm plate 203 is shown as being connected to housing 202. The filter section 228 of diaphragm plate 203 lines up with the supply manifold 402 formed by groove 212. Restrictor plate 204 is sandwiched between diaphragm plate 203 and chamber plate 205. Restrictor plate 204 includes restrictor 222 that controls a flow of ink from the supply manifold 402 to chamber 310. Chamber plate 205 forms the chamber 310 for the ink channel 302. Orifice plate 208 has the nozzle 220 for the ink channel 302.

Figure 5:
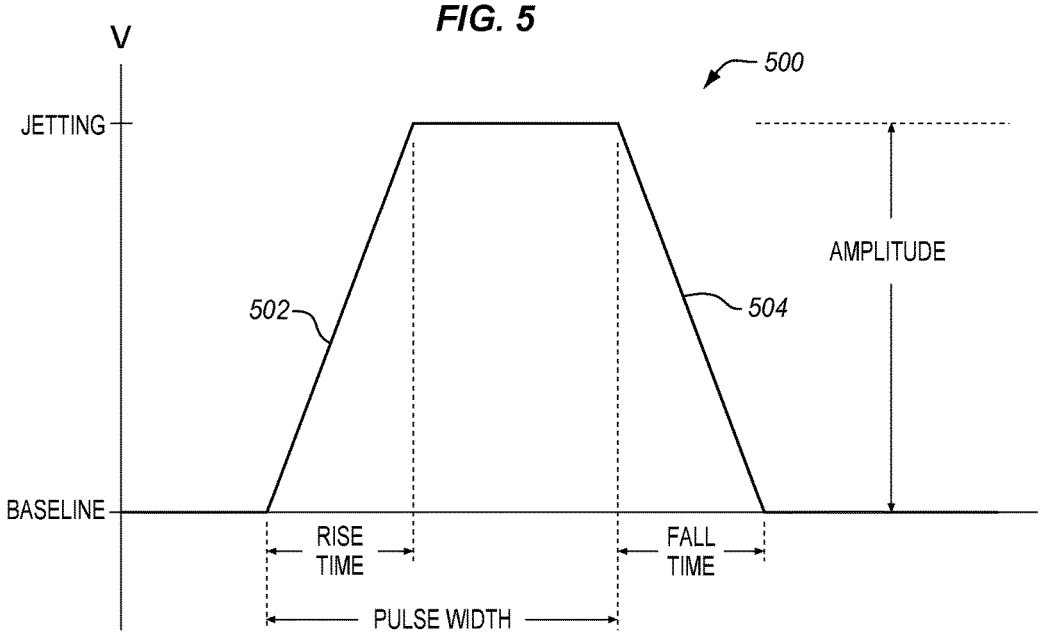
FIG. 5 illustrates a standard jetting pulse for an inkjet head.

Piezoelectric actuator 230 is the actuating device for ink channel 302 to jet a droplet. Piezoelectric actuator 230 converts electrical energy directly into linear motion. To jet from ink channel 302, a drive waveform is provided to piezoelectric actuator 230 with one or more jetting pulses. A jetting pulse causes a deformation, physical displacement, or stroke of piezoelectric actuator 230, which in turn acts to deform a wall of chamber 310. Deformation of the chamber wall generates pressure waves inside ink channel 302 that are able to jet a droplet from ink channel 302 (when specific conditions are met). A standard jetting pulse is therefore able to cause a droplet to be jetted from ink channel 302 with the desired properties when ink channel 302 is at rest. FIG. 5 illustrates a standard jetting pulse 500 for an inkjet head. Jetting pulse 500 may be characterized by the following parameters: rise time, fall time, pulse width, and amplitude. Jetting pulse 500 transitions from a baseline voltage to a target jetting voltage. The potential difference between the baseline and the target jetting voltage represents the amplitude of jetting pulse 500. These parameters of jetting pulse 500 can impact the jetting characteristics of the droplets from the inkjet head (e.g., droplet velocity and mass). For example, a target amplitude of jetting pulse 500 provides a droplet of a desired velocity and mass to be jetted from an ink channel. A standard jetting pulse 500 may be selected for different types of inkjet heads to produce droplets having a desired shape (e.g., spherical), size, velocity, etc.

The following provides an example of jetting a droplet from an ink channel using jetting pulse 500, such as from ink channel 302 in FIG. 4. The leading edge 502 (i.e., the first slope) of jetting pulse 500 causes a piezoelectric actuator to displace in a first direction, which enlarges the ink channel and generates negative pressure waves within the ink channel. The negative pressure waves propagate within the ink channel and are reflected by structural changes in the ink channel as positive pressure waves. The trailing edge 504 (i.e., the second slope) of jetting pulse 500 causes the piezoelectric actuator to displace in an opposite direction, which reduces the ink channel to its original size and generates another positive pressure wave. When the timing of the trailing edge 504 of jetting pulse 500 is appropriate, the positive pressure wave created by the piezoelectric actuator displacing to reduce the ink channel size will combine with the reflected positive pressure waves to form a combined wave that is large enough to cause a droplet to be jetted from the nozzle of the ink channel. Therefore, the positive pressure wave generated by the trailing edge of jetting pulse 500 acts to amplify the positive pressure waves that reflect within the ink channel due to the leading edge 502 of jetting pulse 500. The geometry of the ink channel and the drive waveform are designed to generate a large positive pressure peak at the nozzle, which drives the ink through the nozzle.

Temperature of an inkjet head may affect the jetting characteristics. Therefore, it is desirable to have a uniform temperature distribution across the inkjet head so that jetting characteristics are likewise uniform for each of the ink channels. To produce a uniform temperature distribution across the inkjet head, the piezoelectric actuators in the inkjet head are used to convert electrical energy into heat. If a region of the inkjet head is "cool", then specialized waveforms are provided to piezoelectric actuators in that region to generate heat without causing those piezoelectric actuators to jet ink. A more detailed description of this concept is described below.

Figure 6:
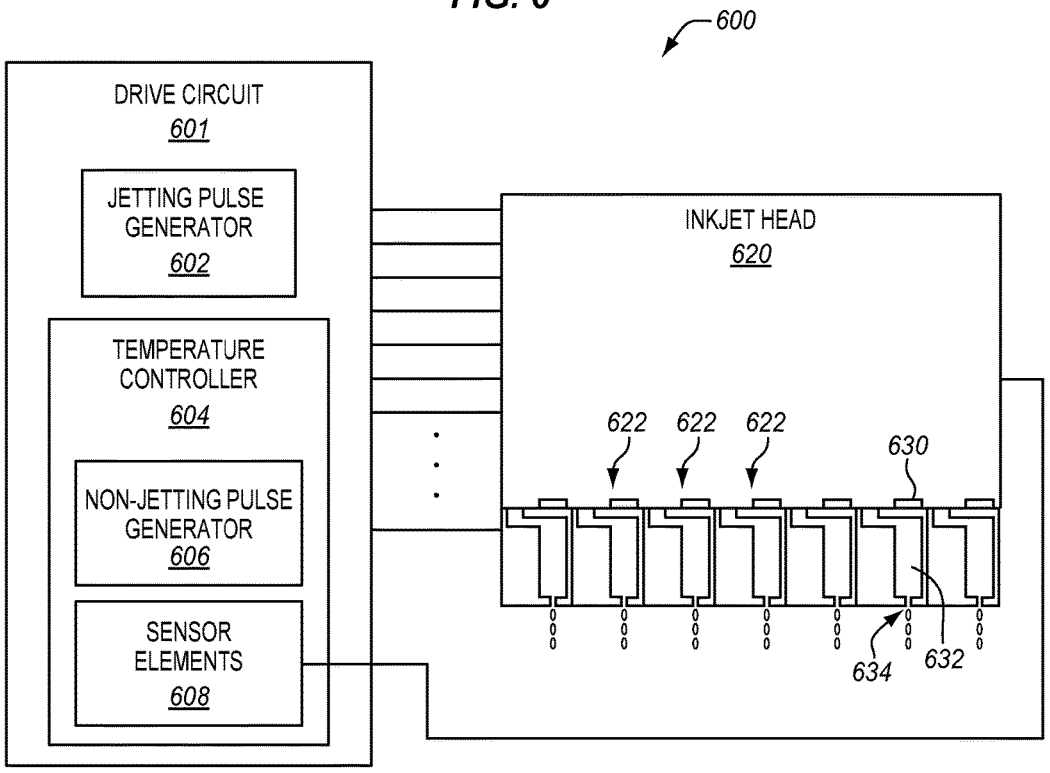
FIG. 6 illustrates an inkjet system in an exemplary embodiment.

FIG. 6 illustrates an inkjet system 600 in an exemplary embodiment. Inkjet system 600 includes a drive circuit 601 for providing waveforms to piezoelectric actuators of an inkjet head, such as inkjet head 620. Inkjet head 620 is illustrated as including a plurality of ink channels 622, with each ink channel 622 including a piezoelectric actuator 630, a chamber 632, and a nozzle 634. The representation of inkjet head 620 is just an example, as drive circuit 601 may connect to different types of inkjet heads. Inkjet head 620 may have a similar structure as shown for inkjet head 100 shown in FIGS. 1-4.

Drive circuit 601 includes a jetting pulse generator 602 and a temperature controller 604. Jetting pulse generator 602 comprises a circuit, firmware, or component that generates drive waveforms for piezoelectric actuators 630 of inkjet head 620, where the drive waveforms include jetting pulses. A "jetting pulse" is defined as a pulse that causes a droplet to be jetted from an ink channel 622 with the desired properties. Jetting pulse generator 602 is configured to selectively provide the jetting pulses to ink channels 622 to discharge ink onto a medium. A medium described herein comprises any type of material upon which ink or another liquid is applied by an inkjet head for printing, such as paper, a substrate for 3D printing, cloth, etc.

Temperature controller 604 comprises a circuit, firmware, or component that adjusts, modifies, or changes the temperature across inkjet head 620. Temperature controller 604 includes a non-jetting pulse generator 606. Non-jetting pulse generator 606 comprises a circuit, firmware, or component that generates heating waveforms for piezoelectric actuators 630 of inkjet head 620, where the heating waveforms include non-jetting pulses. A "non-jetting pulse" is defined as a pulse that causes a piezoelectric actuator of an ink channel to actuate or fire, but does not cause a droplet to be jetted from the ink channel. For example, the pulse width of a non-jetting pulse may be longer than a jetting pulse so that a droplet is not jetted from the ink channel. In an inkjet head with a resonant frequency of about 83 kHz, the pulse width of a standard jetting pulse may be about 6 microseconds. At a pulse width of 6 microseconds, the pressure waves in an ink channel combine and peak at the nozzle to jet a droplet from a nozzle. If the non-jetting pulse has a pulse width between about 12-14 microseconds in an 83 kHz head, then the pressure waves can destructively interfere with one another in the ink channel so that the combined pressure wave is not large enough to jet a droplet from the ink channel.

Figure 7:
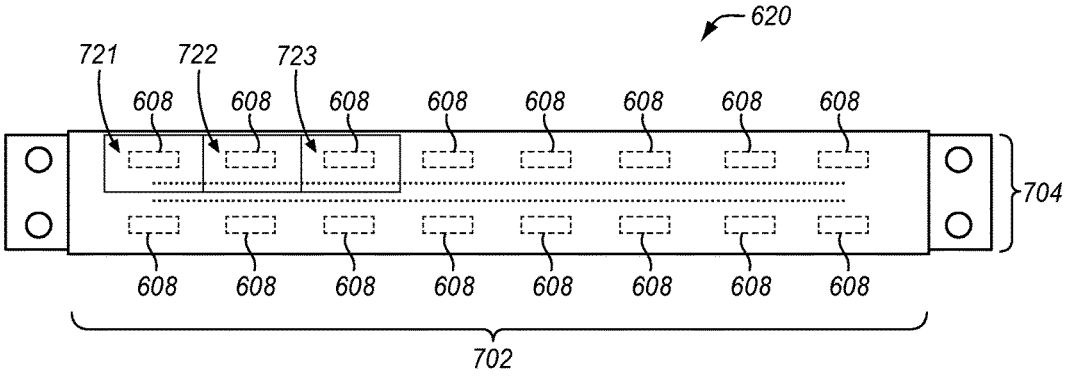
FIG. 7 illustrates sensor elements in an inkjet head in an exemplary embodiment.

Temperature controller 604 may also include sensor elements 608 in one embodiment. Sensor elements 608 comprise circuits, firmware, or components that measure or monitor a temperature in inkjet head 620. One or more of sensor elements 608 may be attached to or embedded within inkjet head 620, and provide temperature data for inkjet head 620 to temperature controller 604. For example, sensor elements 608 may comprise thermocouples that are embedded within inkjet head 620. Sensor elements 608 may be distributed along a length (and width) of inkjet head 620 so that the temperature may be monitored at different regions of inkjet head 620. FIG. 7 illustrates sensor elements 608 in inkjet head 620 in an exemplary embodiment. The view in FIG. 7 is from the nozzle plate surface of inkjet head 620. Sensor elements 608 are embedded or connected to inkjet head 620, and are distributed along a length 702 and/or width 704 of inkjet head 620. In this embodiment, each sensor element 608 is associated with a region of inkjet head 620. For example, one sensor element 608 is associated with region 721, another sensor element 608 is associated with region 722, another sensor element 608 is associated with region 723, etc. Each sensor element 608 is configured to measure a temperature in its associated region (721, 722, 723, . . . ), and report temperature data back to temperature controller 604 (see FIG. 6).

Figure 8:
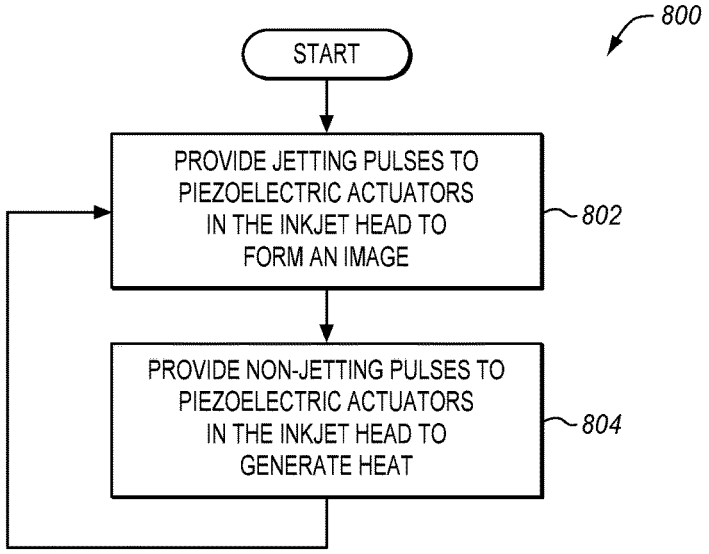
FIG. 8 is a flow chart illustrating a method 800 of operating drive circuit 601 in an exemplary embodiment.

FIG. 8 is a flow chart illustrating a method 800 of operating drive circuit 601 in an exemplary embodiment. The steps of method 800 will be described with respect to inkjet system 600 in FIG. 6, although one skilled in the art will understand that the methods described herein may be performed by other devices or systems not shown. The steps of the methods described herein are not all inclusive and may include other steps not shown.

In step 802, jetting pulse generator 602 provides drive waveforms to inkjet head 620 under normal printing operations. Jetting pulse generator 602 provides jetting pulses to piezoelectric actuators 630 in selected ink channels 622 in inkjet head 620 to form an image on a medium. The jetting pulses sent to selected ink channels 622 cause piezoelectric actuators 630 in the selected ink channels 622 to jet a droplet.

There may be uneven jetting patterns in inkjet head 620 during printing operations, which causes some of ink channels 622 in inkjet head 620 to be dormant for a time period. Thus, some regions of inkjet head 620 may be cooler than others causing an uneven temperature distribution across inkjet head 620. Additionally, environmental conditions within a printer may cause an uneven temperature distribution across inkjet head 620. Uneven temperature distribution can negatively affect the jetting characteristics of inkjet head 620.

To create a more uniform temperature distribution, non-jetting pulse generator 606 provides one or more non-jetting pulses to piezoelectric actuators 630 in inkjet head 620 (step 804). In response to the non-jetting pulses, piezoelectric actuators 630 convert the electric energy of the pulses to heat without jetting a droplet from their corresponding ink channels. Therefore, piezoelectric actuators 630 are able to increase the temperature of inkjet head 620 without actually jetting ink onto the medium. Non-jetting pulse generator 606 may adjust the amount of heat generated by piezoelectric actuators 630 so that a target heat is reached. For example, non-jetting pulse generator 606 may increase the number of non-jetting pulses sent to piezoelectric actuators 630 to increase the heat generated by piezoelectric actuators 630, or may decrease the number of non-jetting pulses sent to piezoelectric actuators 630 to decrease the heat generated by piezoelectric actuators 630. Non-jetting pulse generator 606 may additionally or alternatively increase the amplitude of the non-jetting pulses to increase the heat generated by piezoelectric actuators 630, or may decrease the amplitude of the non-jetting pulses to decrease the heat generated by piezoelectric actuators 630. Non-jetting pulse generator 606 is able to selectively provide the non-jetting pulses to piezoelectric actuators 630 in inkjet head 620 to change the temperature across inkjet head 620.

Non-jetting pulse generator 606 may determine which piezoelectric actuators 630 to send non-jetting pulses based on a variety of factors. For example, non-jetting pulse generator 606 may apply non-jetting pulses to piezoelectric actuators 630 in ink channels 622 that have not been used for a threshold time period. Non-jetting pulse generator 606 may apply non-jetting pulses to piezoelectric actuators 630 in regions that are known to have lower temperatures based on testing or environmental conditions. Non-jetting pulse generator 606 may apply non-jetting pulses to piezoelectric actuators 630 based on data from sensor elements 608, which is further described in FIG. 9.

Figure 9:
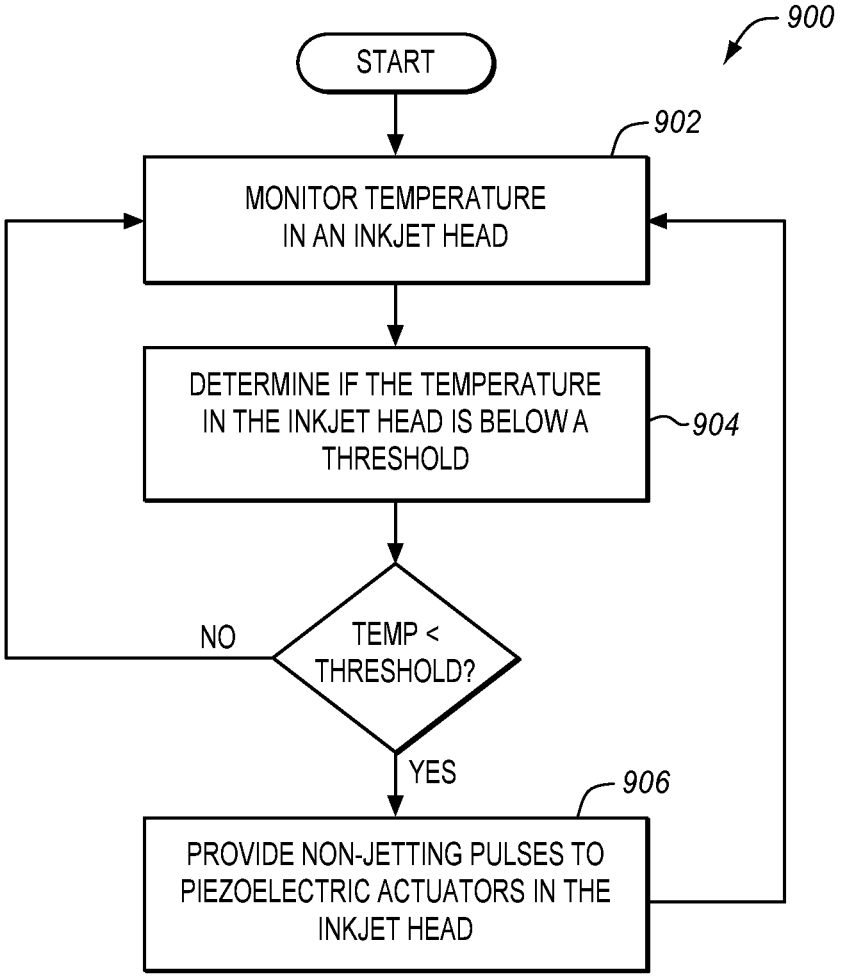
FIG. 9 is a flow chart illustrating a method of controlling temperature in an inkjet head in an exemplary embodiment.

FIG. 9 is a flow chart illustrating a method 900 of controlling temperature in an inkjet head in an exemplary embodiment. The steps of method 900 will be described with respect to inkjet system 600 in FIG. 6, although one skilled in the art will understand that the methods described herein may be performed by other devices or systems not shown. One or more sensor elements 608 monitor a temperature in inkjet head 620, and provide data indicating the temperature in inkjet head 620 to non-jetting pulse generator 606 (step 902). As stated above, sensor elements 608 may be associated with different regions of inkjet head 620, and provide temperature data for their associated regions to non-jetting pulse generator 606. That way, temperature measurements can be taken independently in different regions of inkjet head 620. Non-jetting pulse generator 606 determines whether the temperature in inkjet head 620 is below a threshold (step 904). If the temperature in inkjet head 620 is below the threshold, then non-jetting pulse generator 606 provides one or more non-jetting pulses to piezoelectric actuators 630 in inkjet head 620 (step 906). In response to the non-jetting pulses, piezoelectric actuators 630 convert the electric energy of the pulses to heat without jetting a droplet from their corresponding ink channels. Non-jetting pulse generator 606 is able to selectively provide the non-jetting pulses to piezoelectric actuators 630 in inkjet head 620 to change the temperature in localized regions of inkjet head 620. As shown in FIG. 7, sensor elements 608 may be associated with localized regions 721-723 of inkjet head 620. When a sensor element 608 provides temperature data about a particular region 721-723 of inkjet head 620, non-jetting pulse generator 606 may identify one or more piezoelectric actuators 630 in that region of inkjet head 620. Non-jetting pulse generator 606 may then provide the non-jetting pulses to the piezoelectric actuators 630 identified to be in that region of inkjet head 620. That way, heating will be localized in inkjet head 620 to produce a uniform temperature distribution along inkjet head 620.

Non-jetting pulse generator 606 may provide the non-jetting pulses to piezoelectric actuators 630 that are inactive for a printing operation. For example, non-jetting pulse generator 606 may communicate with jetting pulse generator 602 to identify which ink channels 622 are being used for a print operation. Non-jetting pulse generator 606 may then select other ink channels that are not being used for print operations, and use these ink channels for heating the inkjet head 620.

Figure 10:
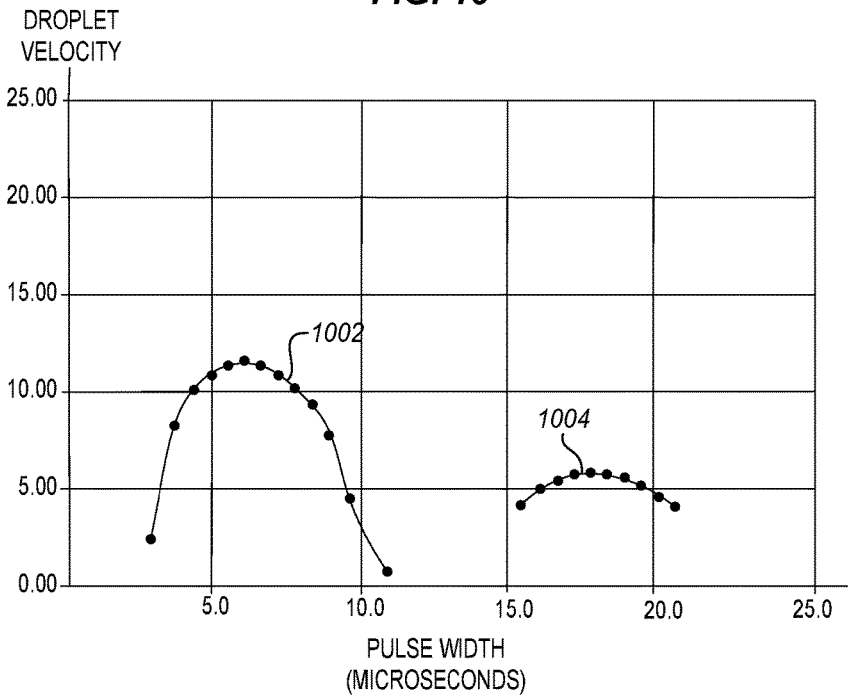
FIG. 10 illustrates jetting characteristics for an inkjet head in an exemplary embodiment.

The parameters of the non-jetting pulse may be determined based on the jetting characteristics of an inkjet head. FIG. 10 illustrates jetting characteristics for an inkjet head in an exemplary embodiment. The vertical axis in FIG. 10 represents the velocity of droplets measured from the inkjet head, and the horizontal axis in FIG. 10 represents different pulse widths of jetting pulses supplied to the inkjet head. Due to the structure of the ink channels in the inkjet head, there are resonant frequencies for the ink channels. The resonant frequencies for an ink channel occur when reflected pressure waves in the ink channel amplify a positive pressure wave. In the example shown in FIG. 10, one set of resonant frequencies 1002 occurs when the pulse width of the jetting pulse is between about 3 and 11 microseconds, with a peak at about 6 microseconds. Another set of resonant frequencies 1004 occurs when the pulse width of the jetting pulse is between about 15-22 microseconds, with a peak at about 18 microseconds. There may be additional resonant frequencies that are not shown. Also evident in FIG. 10 is that an ink channel does not jet a droplet (i.e., droplet velocity is zero) between the sets of resonant frequencies 1002-1004. For example, when the pulse width of the jetting pulse is between about 12 and 14 microseconds, the ink channel does not jet a droplet in response to the pulse. Therefore, the non-jetting pulse described herein may be set to have a pulse width that is between the sets of resonant frequencies 1002-1004 of the ink channel, which would be between about 12 and 14 microseconds in this example. The pulse width of the jetting pulse may alternatively be set between resonant frequency 1004 and the next resonant frequency (not shown in FIG. 10). Therefore, the non-jetting pulse may be set to have a pulse width between about 24 and 26 microseconds in another example.

Figure 11:
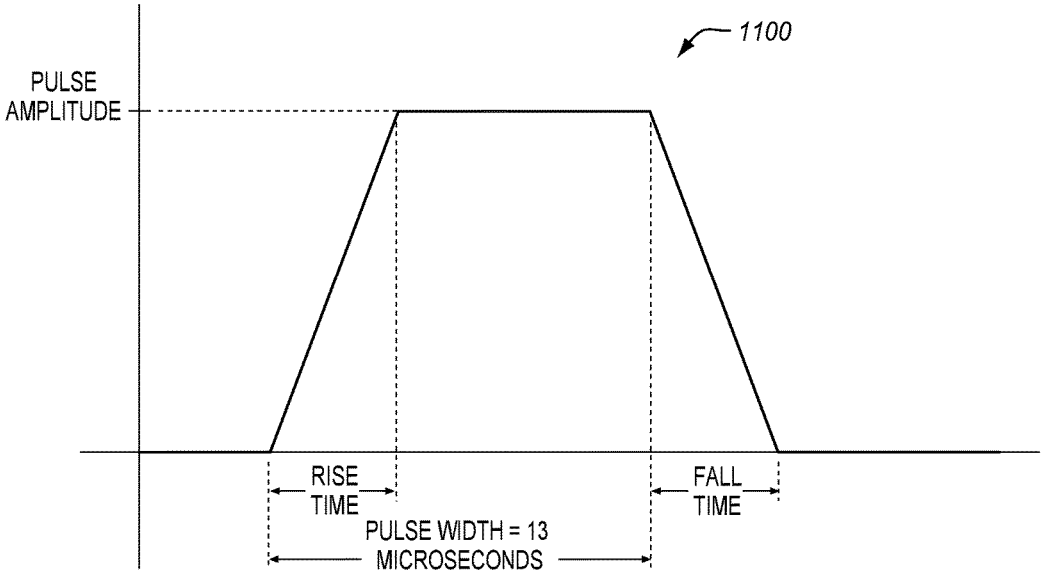
FIG. 11 illustrates a non-jetting pulse in an exemplary embodiment.

FIG. 11 illustrates a non-jetting pulse 1100 in an exemplary embodiment. In this example, the pulse width of non-jetting pulse 1100 is between the sets of resonant frequencies 1002-1004 of the ink channel, which is at about 13 microseconds. When this non-jetting pulse 1100 is provided to a piezoelectric actuator, the piezoelectric actuator will convert the electrical energy from the pulse into heat but will not cause a droplet to be jetted from the ink channel. That way, the piezoelectric actuator can be used as a heater in the inkjet head so that the temperature distribution across the inkjet head is uniform.

Any of the various components shown in the figures or described herein may be implemented as hardware, software, firmware, or some combination of these. For example, a component may be implemented as dedicated hardware. Dedicated hardware elements may be referred to as "processors", "controllers", or some similar terminology. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, a network processor, application specific integrated circuit (ASIC) or other circuitry, field programmable gate array (FPGA), read only memory (ROM) for storing software, random access memory (RAM), non-volatile storage, logic, or some other physical hardware component or module.

Also, a component may be implemented as instructions executable by a processor or a computer to perform the functions of the component. Some examples of instructions are software, program code, and firmware. The instructions are operational when executed by the processor to direct the processor to perform the functions of the element. The instructions may be stored on storage devices that are readable by the processor. Some examples of the storage devices are digital or solid-state memories, magnetic storage media such as a magnetic disks and magnetic tapes, hard drives, or optically readable digital data storage media.

Although specific embodiments were described herein, the scope of the invention is not limited to those specific embodiments. The scope of the invention is defined by the following claims and any equivalents thereof.

What is claimed is:

1. A system comprising:

an inkjet head comprising a plurality of ink channels that are configured to jet droplets of a liquid material onto a medium using piezoelectric actuators;

a jetting pulse generator configured to provide jetting pulses to the piezoelectric actuators to jet the droplets from the ink channels; and a temperature controller comprising:

sensor elements distributed within the inkjet head, with each sensor element associated with a different localized region of the inkjet head and configured to measure a temperature in the localized region; and a non-jetting pulse generator configured to receive data from the sensor elements, to determine that the temperature in the localized region associated with one of the sensor elements is below a threshold based on the data, and to provide non-jetting pulses to selected ones of the piezoelectric actuators in the localized region associated with the one of the sensor elements to generate heat in the localized region.

2. The system of claim 1 wherein:

the non-jetting pulse generator is configured to increase a number of the non-jetting pulses provided to the selected ones of the piezoelectric actuators to increase the heat generated by the selected ones of the piezoelectric actuators.

3. The system of claim 1 wherein:

the non-jetting pulse generator is configured to decrease a number of the non-jetting pulses provided to the selected ones of the piezoelectric actuators to decrease the heat generated by the selected ones of the piezoelectric actuators.

4. The system of claim 1 wherein:

the non-jetting pulse generator is configured to increase an amplitude of the non-jetting pulses provided to the selected ones of the piezoelectric actuators to increase the heat generated by the selected ones of the piezoelectric actuators.

5. The system of claim 1 wherein:

the non-jetting pulse generator is configured to decrease an amplitude of the non-jetting pulses provided to the selected ones of the piezoelectric actuators to decrease the heat generated by the selected ones of the piezoelectric actuators.

6. The system of claim 1 wherein:

the non-jetting pulses have a pulse width that is longer than the jetting pulses.

7. The system of claim 1 wherein:

due to a structure of the ink channels in the inkjet head, a first set of resonant frequencies occur in the ink channels due to the jetting pulses having a first range of pulse widths, and a second set of resonant frequencies occur in the ink channels due to the jetting pulses having a second range of pulse widths; and the non-jetting pulses have a pulse width that is between the first range of pulse widths for the first set of resonant frequencies and the second range of pulse widths for the second set of resonant frequencies.

8. The system of claim 1 wherein:

the non-jetting pulse generator is configured to provide the non-jetting pulses to the selected ones of the piezoelectric actuators that have not been used for a threshold time period.

9. The system of claim 1 wherein:

the non-jetting pulse generator is configured to provide the non-jetting pulses to the selected ones of the piezoelectric actuators that are inactive for a printing operation.

10. A method of operating an inkjet head comprising a plurality of ink channels that jet droplets of a liquid material onto a medium using piezoelectric actuators, the method comprising:

providing jetting pulses to the piezoelectric actuators to jet the droplets from the ink channels;

receiving data from sensor elements distributed within the inkjet head, wherein each sensor element is associated with a different localized region of the inkjet head and is configured to measure a temperature in the localized region;

determining that the temperature in the localized region associated with one of the sensor elements is below a threshold based on the data; and providing non-jetting pulses to selected ones of the piezoelectric actuators in the localized region associated with the one of the sensor elements to generate heat in the localized region.

11. The method of claim 10 further comprising:

increasing a number of the non-jetting pulses provided to the selected ones of the piezoelectric actuators to increase the heat generated by the selected ones of the piezoelectric actuators.

12. The method of claim 10 further comprising:

decreasing a number of the non-jetting pulses provided to the selected ones of the piezoelectric actuators to decrease the heat generated by the selected ones of the piezoelectric actuators.

13. The method of claim 10 further comprising:

increasing an amplitude of the non-jetting pulses provided to the selected ones of the piezoelectric actuators to increase the heat generated by the selected ones of the piezoelectric actuators.

14. The method of claim 10 further comprising:

decreasing an amplitude of the non-jetting pulses provided to the selected ones of the piezoelectric actuators to decrease the heat generated by the selected ones of the piezoelectric actuators.

15. The method of claim 10 wherein:

the non-jetting pulses have a pulse width that is longer than the jetting pulses.

16. The method of claim 10 wherein:

due to a structure of the ink channels in the inkjet head, a first set of resonant frequencies occur in the ink channels due to the jetting pulses having a first range of pulse widths, and a second set of resonant frequencies occur in the ink channels due to the jetting pulses having a second range of pulse widths; and the non-jetting pulses have a pulse width that is between the first range of pulse widths for the first set of resonant frequencies and the second range of pulse widths for the second set of resonant frequencies.

17. The method of claim 10 wherein providing non-jetting pulses to selected ones of the piezoelectric actuators comprises:

providing the non-jetting pulses to the selected ones of the piezoelectric actuators that have not been used for a threshold time period.

18. The method of claim 10 wherein providing non-jetting pulses to selected ones of the piezoelectric actuators comprises:

providing the non-jetting pulses to the selected ones of the piezoelectric actuators that are inactive for a printing operation.

19. A system comprising:

an inkjet head comprising a plurality of ink channels that jet droplets of a liquid material onto a medium using piezoelectric actuators;

a jetting pulse generator configured to provide jetting pulses to the piezoelectric actuators to jet the droplets from the ink channels, wherein due to a structure of the ink channels in the inkjet head, a first set of resonant frequencies occur in the ink channels due to the jetting pulses having a first range of pulse widths, and a second set of resonant frequencies occur in the ink channels due to the jetting pulses having a second range of pulse widths; and a temperature controller comprising:

a non-jetting pulse generator configured to provide non-jetting pulses to selected ones of the piezoelectric actuators to generate heat;

wherein the non-jetting pulses have a pulse width that is between the first range of pulse widths for the first set of resonant frequencies and the second range of pulse widths for the second set of resonant frequencies;

wherein the non-jetting pulses cause the selected ones of the piezoelectric actuators to actuate without jetting a droplet from its corresponding ink channel.

20. The system of claim 19 wherein:

the non-jetting pulse generator is configured to provide the non-jetting pulses to the selected ones of the piezoelectric actuators that are inactive for a printing operation.

* * * * *